United States Patent [19]

Bailey et al.

[11] Patent Number: 5,013,216

[45] Date of Patent: May 7, 1991

[54] COMPOSITE BLADE PERFORM WITH DIVERGENT ROOT

[75] Inventors: Carlos Bailey, Farmington; Raymond G. Spain, Farmington Hills, both of Mich.

[73] Assignee: Airfoil Textron Inc., Lima, Ohio

[21] Appl. No.: 442,595

[22] Filed: Nov. 29, 1989

Related U.S. Application Data

[62] Division of Ser. No. 243,074, Sep. 9, 1988.

[51] Int. Cl.[5] ..... F01D 5/14

[52] U.S. Cl. ..... 416/230; 416/224; 29/889.71

[58] Field of Search ..... 416/230, 224, 229 A; 29/889.2, 889.71; 87/6, 9

[56] References Cited

U.S. PATENT DOCUMENTS

| | | | |
|---|---|---|---|
| 2,929,755 | 3/1960 | Porter | 264/161 |
| 3,057,767 | 10/1962 | Kaplan | 156/172 |
| 3,549,444 | 12/1970 | Katz | 29/156.8 B |
| 3,645,829 | 2/1972 | Palfreyman et al. | 29/156.8 B X |
| 3,737,250 | 6/1973 | Pilpel et al. | 416/219 |
| 4,312,261 | 1/1982 | Florentine | 87/33 |
| 4,339,229 | 7/1982 | Rossman | 416/218 |
| 4,343,593 | 8/1982 | Harris | 416/193 A |
| 4,492,737 | 1/1985 | Conolly | 428/552 |
| 4,589,176 | 5/1986 | Rosman et al. | 29/156.8 B |
| 4,621,560 | 11/1986 | Brown et al. | 87/33 X |
| 4,648,921 | 3/1987 | Nutler, Jr. | 29/156.8 B X |
| 4,696,866 | 9/1987 | Tanaka et al. | 428/614 |
| 4,719,837 | 1/1988 | McConnell et al. | 87/1 |

*Primary Examiner*—John T. Kwon

*Attorney, Agent, or Firm*—Reising, Ethington, Barnard, Perry & Milton

[57] ABSTRACT

A braided gas turbine engine blade preform includes an airfoil precursor portion and an integral root precursor portion. A plurality of fiber shaping inserts are disposed in the root precursor portion, to impart an enlarged, divergent shape (e.g., dovetail precursor shape) to the braided root precursor portion. The braided preform with the enlarged, shaped root precursor portion is infiltrated with matrix material and shaped to near net shape to provide a composite blade with a dovetail shaped root.

10 Claims, 3 Drawing Sheets

COMPOSITE BLADE PERFORM WITH DIVERGENT ROOT

This is a division, of application Ser. No. 243,074, filed on Sept. 9, 1988.

FIELD OF THE INVENTION

This invention relates to a filament reinforced gas turbine engine blade and, more particularly, to a 3D fiber preform reinforced gas turbine blade and process for making same. A 3D fiber preform is also disclosed.

BACKGROUND OF THE INVENTION

It is known to utilize filaments in the reinforcement of gas turbine engine components such as compressor and turbine blades and vanes (hereinafter referred to as "blade(s)"). In particular, the potential for usage of high modulus, high strength fibers, such as carbon, silicon carbide, boron and others in a resin or metal matrix is widely recognized.

One of the problems in using filamentary reinforcements in gas turbine engine blades resides in providing suitable means for mounting them on a ring, hub, disk or other support in the compressor or turbine section of the engine. Typically, a blade requires an enlarged base (referred to as the root) formed to a shape (e.g., typically a dovetail shape) adapted for mounting on the ring, hub, disk or other support in the compressor turbine section. Typically, the root is inserted in a dovetail slot in the ring, hub, disk or other support and may be pinned thereto by an attachment pin inserted through the blade root.

There is a need to provide a 3D fiber preform reinforced composite blade having a root with a desired enlarged, divergent shape, such as a dovetail shape, for insertion in a complementary slot in the ring, hub, side or other support.

The Warken U.S. Pat. No. 2,995,777 issued Aug. 15, 1961, discloses the formation of a dovetail configuration in a blade root by laying up impregnated cloth or rovings about a shank member.

The Wilder U.S. Pat. No. 3,132,841 issued May 12, 1964; the Stargardter U.S. Pat. No. 3,679,324 issued July 25, 1972 and the Stone U.S. Pat. No. 3,731,360 issued May 8, 1973, illustrate the forming of a dovetail configuration of a blade by the use of wedges inserted into the end of a laminated preform.

Three-dimensional (3D) braiding is a known process for forming fiber preforms by continuous intertwining of fibers. During the 3D braiding process, a plurality of fiber carriers in a matrix array are moved simultaneously across a carrier surface. A fiber extends from each carrier member and is intertwined with fibers from other carrier members as they are simultaneously moved. The fibers are gathered above the carrier surface by suitable means. The 3D braiding process is characterized by an absence of planes of delamination in the preform and results in a tough, crack growth resistant composite article when the preform is impregnated with resin (such as epoxy), metal or other known matrix materials. The Bluck U.S. Pat. No. 3,426,804 issued Feb. 11, 1969, and the Florentine U.S. Pat. No. 4,312,761 issued Jan. 26, 1982, illustrate machines for braiding a 3D article preform using fiber carriers in a rectangular, row-column matrix or circular, concentric-ring matrix.

It is an object of the invention to provide a process for making a 3D braided fiber preform reinforced gas turbine engine blade having an airfoil and an integral root having an enlarged, divergent shape for securing to a ring, hub, disk or other support in the compressor or turbine section of a gas turbine engine.

SUMMARY OF THE INVENTION

The invention contemplates a method for making a composite gas turbine engine blade having an airfoil and an integral, enlarged, divergent root including braiding a plurality of fibers to form a preform having an airfoil precursor portion and an integral root precursor portion, inserting a plurality of fiber shaping inserts into the root precursor portion in a chordwise direction of the blade and in a pattern to impart an enlarged, divergent shape, such as for example a dovetail precursor shape, to the root precursor portion, and infiltrating the preform having the enlarged, divergently shaped root precursor portion with a matrix material to form a composite gas turbine engine blade.

In one embodiment of the invention, the fiber shaping inserts are inserted during the braiding of the preform such that the root precursor portion is braided at least partially around the fiber shaping inserts. In this embodiment, the fiber shaping inserts preferably have a diameter greater than about 0.100 inch, preferably from about 0.130 to about 0.500 inch.

In another embodiment of the invention, the fiber shaping inserts are inserted into the root precursor portion after braiding. In this embodiment, the fiber shaping inserts preferably have a diameter less than about 0.100 inch, preferably from about 0.020 to about 0.080 inch such that the fiber shaping inserts can be inserted by a "sewing" type action. Preferably, the fiber shaping inserts are inserted (sewn) into the root precursor portion beginning in the center of the root precursor portion and proceeding outwardly toward the exterior sides of the root precursor portion.

In these and other embodiments, the fiber shaping inserts may comprise braided fiber inserts, uniaxial fiber bundle inserts overwrapped with one or more helical fiber layers as well as other forms of fiber inserts, and the fiber inserts may include at least a portion, such as a leading end, at least temporarily rigidized to facilitate insertion into the root precursor portion.

In still another embodiment of the invention, a plurality of removable shaping inserts are inserted during the braiding of the preform such that the root precursor portion is braided around the removable shaping inserts. After braiding, the removable shaping inserts are replaced with the fiber shaping inserts having a larger cross-section (e.g., diameter) to provide a tight fit of the fiber shaping inserts in the braided root precursor portion. The removable shaping inserts preferably comprise hollow, tubular shaping inserts through which the larger fiber shaping inserts are pulled after passing through a conical reducer member to temporarily reduce the cross-section of the fiber shaping inserts so as to fit inside the hollow shaping inserts. When the hollow shaping inserts are removed, the fiber shaping inserts remain in the root precursor portion and expand into tight fit therein.

In still another embodiment of the invention, the fiber shaping inserts are inserted through the root precursor portion and project beyond opposite ends thereof. The projecting portions of the fiber shaping inserts are subsequently removed from the composite article.

The invention also contemplates a 3D braided fiber preform having a plurality of fiber shaping inserts extending chordwise therein to impart an enlarged, divergent shape thereto, such as a dovetail precursor shape.

The invention further contemplates a composite gas turbine engine blade including such a 3D braided fiber preform infiltrated with a matrix material and shaped to form a 3D braided airfoil and integral 3D braided root of enlarged, divergent shape by virtue of the presence of a plurality of fiber shaping inserts therein.

BEST MODE FOR PRACTICING THE INVENTION

Figure 1:
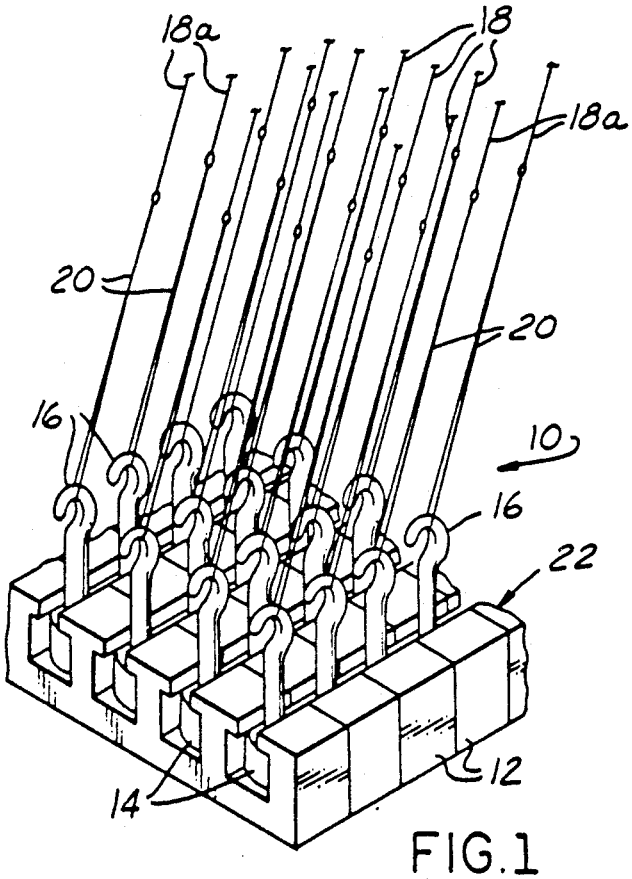
FIG. 1 is a perspective view of a braiding apparatus for practicing the invention.

The method of the present invention can be practiced in connection with different types of braiding apparatus such as braiding apparatus 10 shown in FIG. 1 which generally comprises a plurality of grooved track members 12 and a plurality of movable fiber carriers 14 that are slidably mounted within the grooved track members 12. Each of the fiber carriers 14 is provided with an upper hook portion 16 to which a fiber 18 is connected by an elastic member 20 or like connector means. In accordance with known braiding techniques, predetermined alternate movement of the rows (track members 12) and the columns (fiber carriers 14) of the fiber carrier matrix moves the fiber carriers 14 in predetermined patterns across the carrier surface 22 defined by the track members 12 and effects intertwining of the fibers 18 to form a 3D braided preform P of a desired size and shape. The row and column motion can be effected by any suitable means (not shown) such as mechanical, electrical or pneumatic actuators mounted about the periphery of the braiding apparatus 10 to move the track members 12 back and forth and the fiber carriers 14 orthogonal to movement of the track members.

For high production applications, the braiding apparatus will include a fiber spool on each fiber carrier 14 as described in copending U.S. patent application Ser. No. 191,434 of common assignee herewith now U.S. Pat. No. 4,922,798. Axial stuffer fibers (not shown) may be incorporated into the braided preform in accordance with copending U.S. patent application Ser. No. 191,564 of common assignee herewith.

FIGS. 3–7 illustrate one embodiment of the invention.

In particular, the braiding apparatus 10 described hereinabove is operated to initially braid the airfoil precursor portion PA of the blade preform P by moving the fiber carriers 14 in desired patterns on the carrier surface 22. The airfoil precursor portion PA will have an airfoil cross-sectional shape of variable thickness from the precursor leading edge PLE to the precursor trailing end PTE, FIG. 6. It is apparent that the airfoil precursor portion PA is not twisted about its longitudinal axis L2 as typically required for a composite gas turbine engine blade B. This twist is imparted in a subsequent shaping operation as will be explained hereinbelow.

Figure 4:
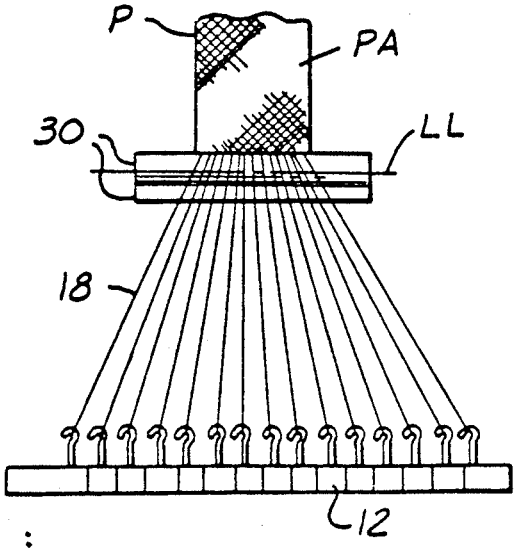
FIG. 4 is similar to FIG. 3 showing the fiber shaping inserts inserted through the fibers extending from the airfoil precursor portion.
Figure 5:
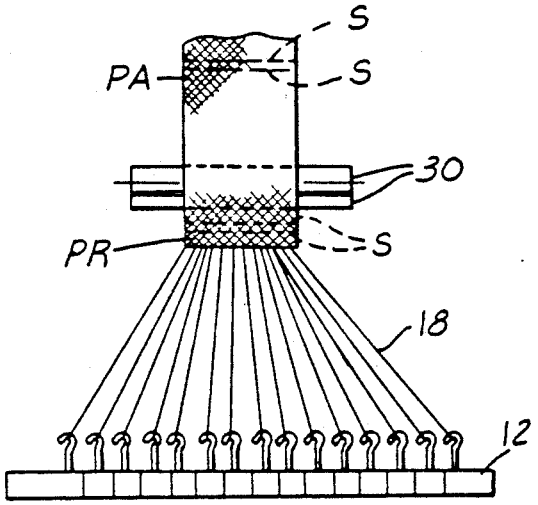
FIG. 5 is similar to FIG. 4 showing the root precursor portion braided around the fiber shaping inserts.

Once the desired length of the airfoil precursor portion PA is braided, a plurality of fiber shaping inserts 30 are inserted in a chordwise direction DC through the fibers 18 at a location LL below the braided airfoil precursor portion PA as shown in FIG. 4. The fibers 18 at location LL are thereby caused to extend around the shaping inserts 30. After insertion of the shaping inserts, normal braiding of the fibers 18 is continued to braid the root precursor portion PR tightly around each of the shaping inserts 30 until a desired length for the root precursor portion is obtained, FIG. 5. Typically, the length of the airfoil precursor portion PA and the root precursor portion PR is oversized and subsequently trimmed as explained below.

Following braiding of the root precursor portion PR, the opposite ends of the resulting preform are stitched with stitches S and the opposite ends are cut between the stitches to free the 3D braided blade preform P for removal. The freed opposite ends may be taped to prevent damage to the cut braid at the ends.

Figure 6:
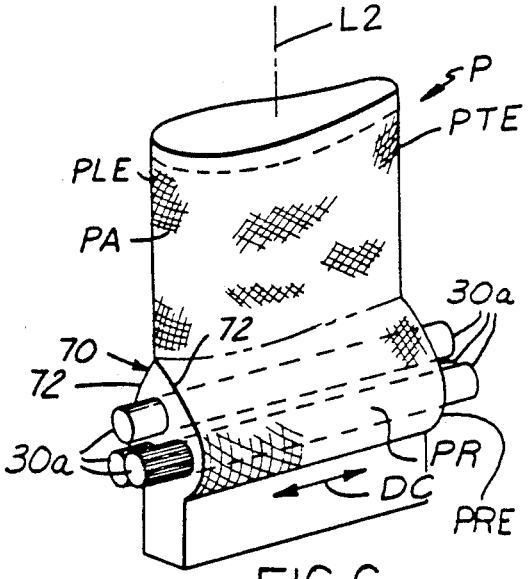
FIG. 6 is a perspective view of the braided preform of the invention.

The fiber shaping inserts 30 are shown as elongated, cylindrical rods and are spaced apart in a pattern in the root precursor portion PR to impart a desired enlarged, divergent shape to the root precursor portion PR braided therearound. In particular, the fiber shaping inserts 30 are spaced in a pattern to impart a dovetail precursor shape 70 to the root precursor portion PR braided therearound. The dovetail precursor shape is shown in FIG. 6 and is enlarged and includes diverging dovetail precursor surfaces 72.

Figure 7:
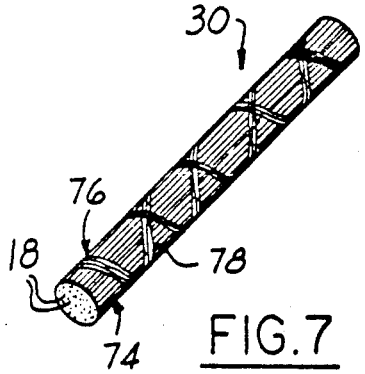
FIG. 7 is a perspective of a fiber shaping insert.

The fiber shaping inserts 30 may each comprise a uniaxial bundle 74 of multiple fibers 18 overwrapped by one or more helical fiber layers; e.g., a helical fiber layer 76, FIG. 7. For purposes of illustration only, each fiber shaping insert 30 could include a uniaxial core comprising 50 plys of 12K carbon fibers with the core tightly overwrapped with a helical layer 76 of 1 ply of 12K carbon fibers (right hand helix) and with the first helical layer 76 tightly overwrapped with a second helical layer 78 of 1 ply of 12K carbon fibers (left hand twist). Such a fiber shaping insert 30 has a diameter of about 0.300 inch.

Those skilled in the art will appreciate that the fiber shaping inserts 30 may be formed in other ways. For example, elongated rod-shaped fiber shaping inserts may comprise 3D braided fiber rods, fiber rope and other fiber forms.

To facilitate insertion of the fiber shaping inserts 30 chordwise through the fibers 18, the inserts 30 may optionally be temporarily or permanently rigidized. In one example, the leading end or point of each inserts 30 (i.e., the end that is first inserted through the fibers 18) is rigidized; e.g., by dipping the leading end in an epoxy bath to form a partial or fully cured epoxy coated end on the insert. The leading end may even be formed to a point to further facilitate in insertion of the fiber shaping inserts 30.

Alternatively, the entire length of each insert may be temporarily rigidized to facilitate insertion among the fibers 18. For example, each fiber shaping insert 30 can be dipped in water or other liquid and frozen prior to insertion. After insertion, the frozen liquid can be removed by heating the preform or the frozen liquid itself by microwave radiation and the like. The fiber shaping inserts 30 would then assume a less rigid form in the preform P that would facilitate subsequent shaping or molding of the preform to the desired dovetail shape, especially a divergent dovetail shape shown in FIG. 2, desired for the composite blade B.

As a further alternative, the fiber shaping rods 30 may be partially pyrolyzed to permanently rigidize them. Such partially pyrolyzed fiber shaping inserts 30 would typically comprise partially pyrolyzed carbon fibers. Typically, partially pyrolyzed carbon inserts 30 would be inserted in a braided carbon fiber preform P.

Other techniques for rigidizing the fiber shaping inserts 30, either temporarily or permanently, may be used.

Figure 8:
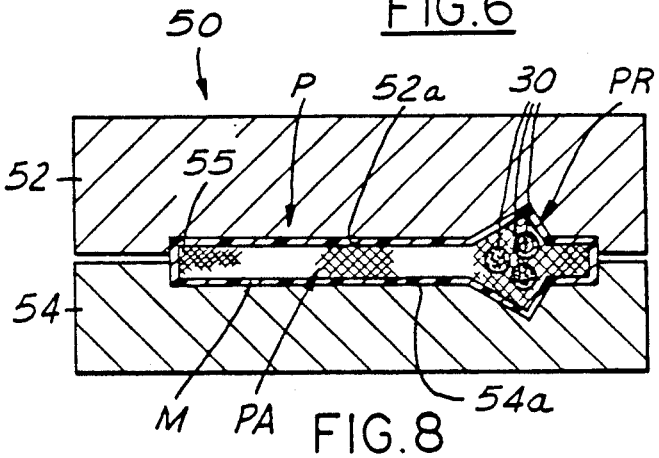
FIG. 8 is a longitudinal sectional view of the preform in a mold.

After the braided blade preform P is removed from the braiding apparatus 10, it is subjected to matrix infiltrating and shaping steps to form the composite blade B. In one embodiment of the invention, the freed blade preform P is received in a mold 50, see FIG. 8. The mold 50 includes mold halves 52,54 which include respective mold cavities **52*a*,54*a*. The mold cavities 52*a*,54*a*, when mated together, form a blade shaped cavity 55 having an airfoil portion (which preferably is twisted) and an integral dovetail shaped root portion. The preform P is infiltrated in the blade shaped cavity 55 with matrix material M while the mold halves 52,54** are pressed together by suitable known pressing means (e.g., hydraulic cylinder) to shape the infiltrated airfoil precursor portion PA and the enlarged, shaped root precursor portion PR to desired near net airfoil shape and dovetail root shape.

In another embodiment of the invention for encasing the preform P in a resin matrix M, the braided preform P is first impregnated with resin to form a so-called pre-preg and then the pre-preg is placed in the blade shaped cavity 55 and pressed to shape between the split mold halves 52,54.

When the matrix material M comprises a ceramic material, the braided preform P is first shaped to a desired blade shape and then subjected to a known chemical infiltration (CVI) or chemical vapor deposition (CVD) step to form a ceramic matrix M in and around the shaped preform P.

A metal matrix can be provided by cobraiding metal fibers with reinforcing fibers into the 3D braided preform P on the braiding apparatus 10. The blade preform P can then be heated in a shaping mold to a temperature and at a pressure for a time sufficient to diffusion bond the metal fibers into a bonded, unitary matrix around the reinforcing fibers of the preform P. The blade preform P is shaped in the mold to the desired near net shape. Typical reinforcing fibers that can be used comprise carbon, glass, ceramic, high temperature metal (melting point higher than that of matrix fibers) and like reinforcing fibers. The metal matrix fibers may comprise aluminum, steel, superalloy and like metal fibers. A method for forming a composite article by cobraiding metal matrix-forming fibers and reinforcing fibers is disclosed in copending U.S. patent application Ser. No. 192,157 of common assignee herewith.

As is apparent from the above discussion, the shaping and infiltrating steps may be carried out in any order or concurrently to form the composite blade B.

As mentioned hereinabove and shown in FIG. 6, the fiber shaping inserts 30 are inserted chordwise (direction DC) through the root precursor portion PR past opposite transverse ends PRE so that ends **30*a* of the inserts 30 are exposed. These ends 30*a* typically are trimmed off after the preform P is removed from the braiding apparatus 10**, although they can be removed at other times in the method sequence. For example, they may be present in the composite blade B and removed (by cutting, sawing, etc.) from the composite blade B.

Figure 2:
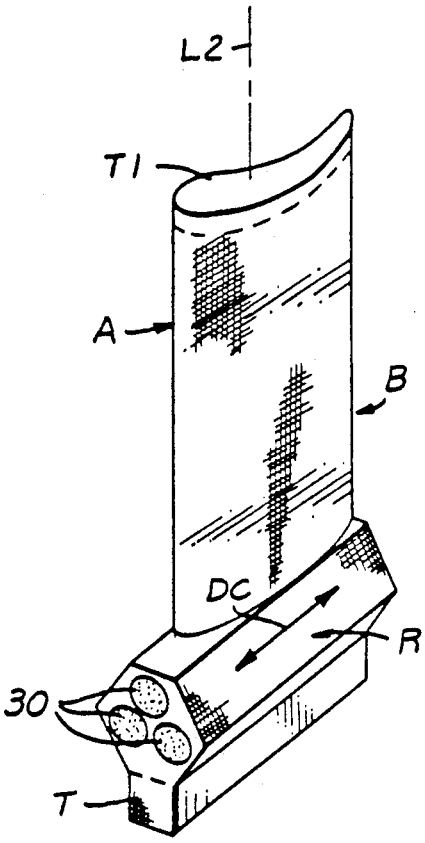
FIG. 2 is a perspective view of a gas turbine engine blade in accordance with one embodiment of the invention.
Figure 3:
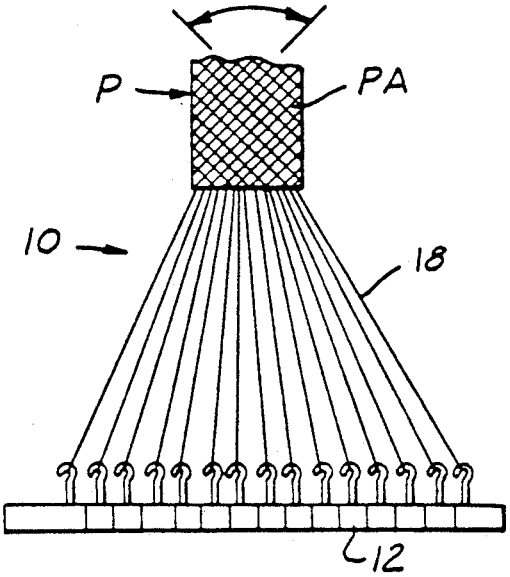
FIG. 3 is a schematic, elevational view of the braiding apparatus for carrying out one embodiment of the invention.

In FIG. 2, the composite blade B is shown with a dovetail shaped root R having a depending tab T. This tab T can be removed by cutting, sawing and the like along the dashed line to provide a finished gas turbine engine blade B. A similar upstanding tab T1 is provided on the airfoil A and is also trimmed off.

Figure 9:
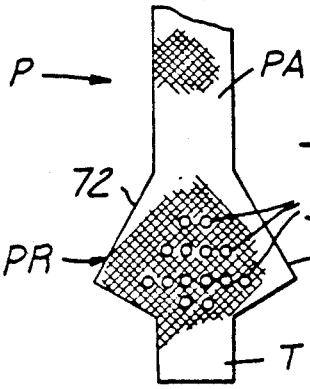
FIG. 9 is an end elevational view of a gas turbine engine preform in accordance with another embodiment of the invention.

FIG. 9 illustrates another embodiment of the invention wherein like features of FIGS. 2–8 are represented by like reference numerals. FIG. 9 illustrates the use of a larger number of fiber shaping inserts 30 spaced apart in a different pattern in the root precursor portion PR of the preform P to aid in achieving the desired dovetail root shape. The fiber shaping inserts 30 can be incorporated into the root precursor portion of the braided preform P as described hereinabove for FIGS. 2–8; i.e., they are inserted among fibers 18 during braiding and the root precursor portion is then braided around the inserts 30. The shaping and infiltrating steps described hereinabove can be used to form the composite gas turbine engine blade B.

Figure 10:
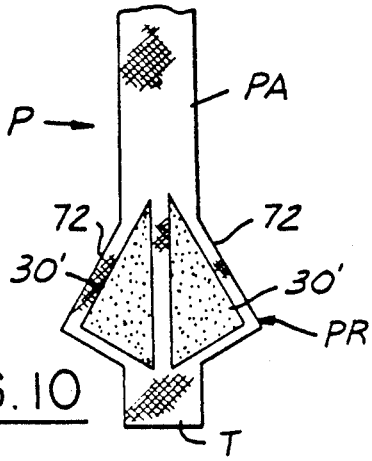
FIG. 10 is an end elevational view of a gas turbine engine preform in accordance with still another embodiment of the invention.

FIG. 10 illustrates still another embodiment of the invention wherein the fiber shaping inserts 30 comprise a pair of fiber shaping wedges to help impart the desired dovetail shap › to the root precursor portion PR. These fiber shaping wedge inserts 30' may be braided fiber wedges, uniaxial fiber wedges or other fibrous wedges. The fiber shaping wedge inserts 30' are inserted in like manner as the fiber shaping rod inserts 30 described hereinabove during the braiding operation so that the root precursor portion of the preform is braided tightly around the fiber shaping wedge inserts 30'.

Figure 11:
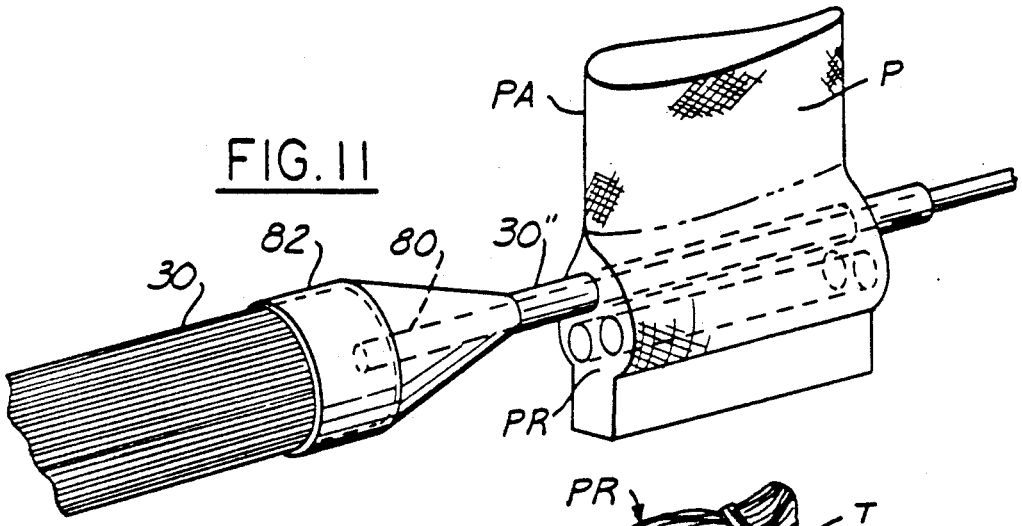
FIG. 11 is a schematic perspective view showing replacement of a removable shaping insert in the root precursor portion with a larger fiber shaping insert.

FIG. 11 illustrates an embodiment of the invention wherein tubular, removable, "dummy" fiber shaping inserts 30" are used in lieu of the fiber shaping inserts 30 of FIGS. 2–8. The removable inserts 30" are inserted during braiding as described hereinabove so that the root precursor portion PR can be braided tightly around each removable insert 30". The removable inserts 30" are hollow and have an outer diameter less than that of the fiber shaping inserts 30 to be substituted therefor in the root precursor portion PR.

Replacement of each removable insert 30'' with the larger diameter fiber shaping insert 30 is effected by pulling each fiber shaping insert through a respective removable insert 30'' using for example a pulling wire 80 attached to each insert 30. Each fiber shaping insert 30 is pulled through a conical, converging transition reducer member 82 to temporarily reduce its diameter to fit inside the respective removable insert 30''. When the removable inserts 30'' are removed after each fiber shaping insert 30 has been pulled inside, the fiber shaping inserts 30 expand in diameter into a tight fit in the braided root precursor portion PR.

The removable inserts 30'' may comprise hollow metal tubes having the transition flair 82 attached thereto or positioned adjacent thereto but separate from the insert 30''. Solid removable "dummy" inserts 30'' may also be used.

The embodiments of FIGS. 2–11 described hereinabove are preferably employed to insert relatively large cross-section (e.g., diameter) fiber shaping inserts 30 into the root precursor portion PR of the preform P. In these embodiments, the diameter of the fiber shaping inserts 30 is preferably greater than about 0.100 inch, even more preferably about 0.130 to about 0.500 inch. These embodiments will use fewer fiber shaping inserts 30 than the following embodiment of the invention described hereinbelow.

Figure 12:
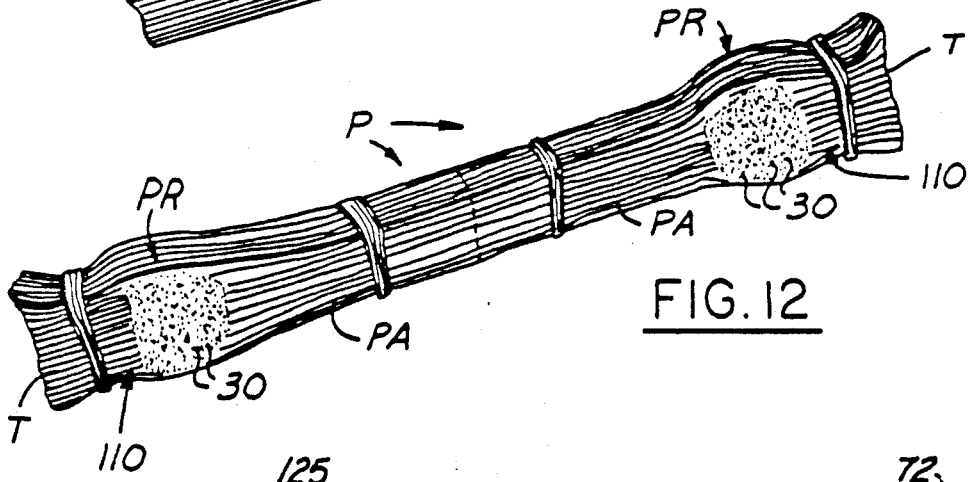
FIG. 12 is a perspective view of a braided preform in accordance with another embodiment of the invention.

Referring to FIG. 12, a braided preform P of another embodiment of the invention having a plurality of relatively small cross-section (e.g., small diameter) fiber shaping inserts 30 inserted chordwise through the root precursor portion PR is shown. A sufficiently large number of these smaller fiber shaping inserts 30 are inserted through the root precursor portions PR to impart an enlarged, divergent shape (dovetail precursor shape) thereto. In this embodiment, the fiber shaping inserts 30 are each preferably less than about 0.100 inch in diameter, even more preferably about 0.020 to about 0.080 inch in diameter. For purposes of illustration, each fiber shaping insert 30 may comprise 2 plys (one loop) of 12K carbon fiber having an outer overall diameter of about 0.040 inch.

Figure 13:
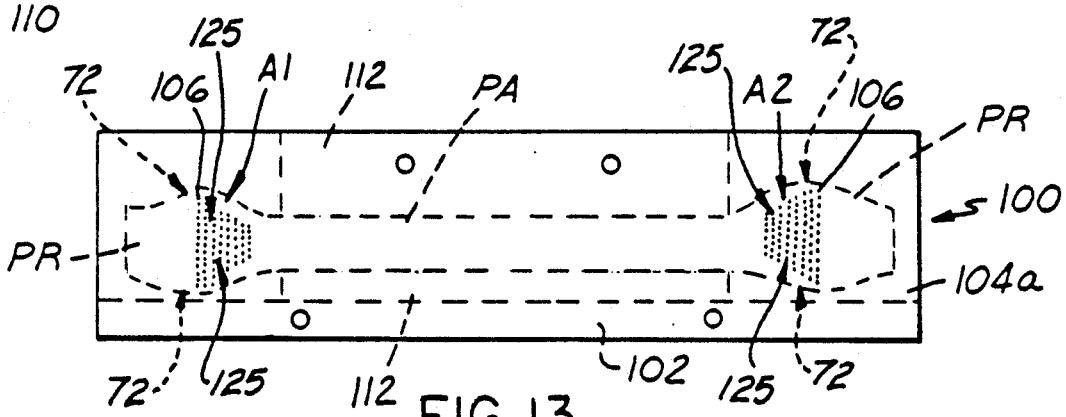
FIG. 13 is a side elevational view of a fixture for sewing the root precursor portion to impart a dovetail shape thereto.
Figure 14:
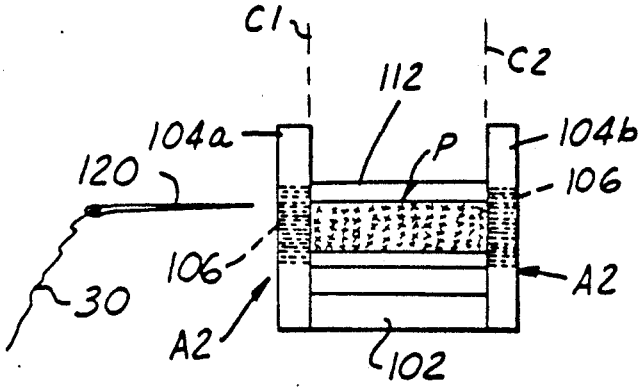
FIG. 14 is an end elevational view of the fixture of FIG. 13.

This embodiment also differs from those described hereinabove for FIGS. 2–10 in that the preform P is braided to include a pair of airfoil precursor portions PA braided in end-to-end relation with a pair of integral root precursor portions PR braided at the opposite ends of the airfoil precursor portions PA and further in that the fiber shaping inserts 30 are inserted in the root precursor portions PR after the braided preform P is removed from the braiding apparatus 10. As a result of the small diameter of the fiber shaping insert 30, they are inserted into the root precursor portions PR using a sewing technique illustrated in FIGS. 13–14.

In particular, the braided preform P is positioned in a fixture 100 having a bottom plate 102 and spaced apart end plates 104*a,b*. As shown, each end plate 104*a,b* includes a pair of apertured areas A1,A2 having apertures 106 disposed in a divergent pattern.

Following removal from the braiding apparatus 10, the preform P is positioned between the end plates 104 *a,b* with the transverse ends 110 of the root precursor portions PR aligned side-by-side adjacent a respective apertured area A1,A2. Clamp plates 112 are then secured between the end plates 104*a,b* overlying and in clamping relation to the airfoil precursor portion PA of the preform P to hold the preform P in aligned position such that the root precursor portions PR can be enlarged and shaped.

After the preform is clamped, a length of fiber shaping insert 30 is attached to a sewing needle 120. The needle then is inserted into end plate 104*a* chordwise through the root precursor portion PR and through the opposite end plate 104*b*. The sewing needle 120 with the length of fiber shaping insert 30 still attached is then inserted through an aperture in end plate 104*b*, chordwise through the root precursor portion PR and through end plate 104*a*. This sewing pattern is begun in the center of the apertured areas A1,A2 and thus in the center of each root precursor portion PR and advances toward the exterior sides 125 of the areas A1,A2 and sides 72 of each root precursor portion PR to impart the desired enlarged, divergent shape (dovetail precursor shape) to each root precursor portion PR.

The fiber shaping insert 30 can be cut outboard of each end plate 104*a,b* to provide end portions (not shown) extending outside of the root precursor portion PR. The fiber shaping insert 30 can be so cut after being pulled through each aperture 106 of the respective end plate 104*a,b* or after the desired enlarged, divergent shape has been sewn into the root precursor portion PR.

When the desired enlarged, divergent shape has been imparted to the root precursor portion PR, the preform P is trimmed along cut lines C1,C2 by a conventional abrasive wheel to free the braided preforms P with enlarged, shaped root precursor portions PR from the fixture 100 for subsequent shaping and infiltration with matrix material as described hereinabove for FIGS. 2–8. The airfoil precursor portions PA that are braided end-to-end may be separated by cutting before or after the shaping and infiltration steps.

While the invention has been described in terms of specific preferred embodiments thereof, it is not intended to be limited thereto but rather only to the extent set forth hereafter in the following claims.

I claim:

1. A gas turbine engine blade preform comprising a 3D braided fiber preform having an airfoil precursor portion and an integral root precursor portion, said root precursor portion having a plurality of fiber inserts extending chordwise of the blade therein to impart an enlarged, divergent shape to said root precursor portion.

2. The preform of claim 1 wherein said fiber inserts comprise braided fiber inserts

3. The preform of claim 1 wherein said fiber inserts comprise uniaxial fiber inserts.

4. The preform of claim 3 wherein uniaxial fiber inserts are overwrapped by helical fibers.

5. The preform of claim 1 wherein said inserts are spaced apart in a pattern in the chordwise direction to impart a dovetail shape to the braided root.

6. The preform of claim 1 wherein said inserts have a diameter greater than about 0.100 inch.

7. The preform of claim 6 wherein said fiber inserts have a diameter of about 0.130 to about 0.500 inch.

8. The preform of claim 1 wherein said inserts have a diameter less than about 0.100 inch.

9. The preform of claim 8 wherein said fiber inserts are sewn into the root precursor portion.

10. The blade of claim 1 wherein each insert is surrounded by a portion of braided root.

* * * * *